US008055152B2

(12) United States Patent
Kishi

(10) Patent No.: US 8,055,152 B2
(45) Date of Patent: Nov. 8, 2011

(54) IMAGE FORMING APPARATUS HAVING MOVABLE DRAWER DETACHABLY SUPPORTING A PLURALITY OF PROCESS CARTRIDGES

(75) Inventor: Isao Kishi, Nagoya (JP)

(73) Assignee: Brother Kogyo Kabushiki Kaisha, Nagoya, Aichi (JP)

( * ) Notice: Subject to any disclaimer, the term of this patent is extended or adjusted under 35 U.S.C. 154(b) by 0 days.

(21) Appl. No.: 12/943,197

(22) Filed: Nov. 10, 2010

(65) Prior Publication Data

US 2011/0058849 A1 Mar. 10, 2011

Related U.S. Application Data

(63) Continuation of application No. 12/408,745, filed on Mar. 23, 2009, now Pat. No. 7,853,175.

(30) Foreign Application Priority Data

Jun. 23, 2008 (JP) ..... 2008-163127

(51) Int. Cl.
*G03G 15/00* (2006.01)

(52) U.S. Cl. ..... 399/110; 399/114

(58) Field of Classification Search ..... 399/16, 399/21–23, 107, 110–114, 124
See application file for complete search history.

(56) References Cited

U.S. PATENT DOCUMENTS

| | | | | |
|---|---|---|---|---|
| 5,493,366 | A * | 2/1996 | Satoh et al. | 399/111 |
| 7,567,769 | B2 | 7/2009 | Noguchi et al. | |
| 7,706,720 | B2 | 4/2010 | Okamoto | |
| 7,715,752 | B2 * | 5/2010 | Sakurai et al. | 399/110 |
| 7,747,190 | B2 | 6/2010 | Kimura et al. | |
| 7,907,868 | B2 | 3/2011 | Igarashi et al. | |
| 2006/0228131 | A1 | 10/2006 | Kimura et al. | |
| 2007/0071494 | A1 | 3/2007 | Igarashi et al. | |
| 2007/0160380 | A1 | 7/2007 | Imaizumi et al. | |
| 2010/0080618 | A1 | 4/2010 | Suzuki | |
| 2010/0226685 | A1 | 9/2010 | Kimura et al. | |

FOREIGN PATENT DOCUMENTS

| | | | |
|---|---|---|---|
| JP | 8-234534 | A | 9/1996 |
| JP | 2006-292982 | A | 10/2006 |
| JP | 2007-121983 | A | 5/2007 |
| JP | 2007-213018 | A | 8/2007 |

OTHER PUBLICATIONS

JP Office Action dtd Mar. 29, 2011, JP Appln. 2008-163127, English translation.

* cited by examiner

*Primary Examiner* — Hoan Tran
(74) *Attorney, Agent, or Firm* — Banner & Witcoff, Ltd.

(57) ABSTRACT

An image forming apparatus capable of easily performing exchange in a process cartridge with a new cartridge and performing removal of a jammed sheet without detachment of a drawer from a casing. The drawer detachably holds a plurality of process cartridges, and is movable in frontward/rearward direction to one of an operable position where each photosensitive drum is in direct confrontation with a conveyer belt, a cartridge exchangeable position where all of the cartridges are positioned out of the casing, and a jammed sheet processing position ahead of the cartridge exchangeable position for removing a jammed sheet. A regulation mechanism is provided for selectively regulating the movement of the drawer dependent on detachment of a rearmost process cartridge from the drawer.

1 Claim, 6 Drawing Sheets

IMAGE FORMING APPARATUS HAVING MOVABLE DRAWER DETACHABLY SUPPORTING A PLURALITY OF PROCESS CARTRIDGES

CROSS REFERENCE TO RELATED APPLICATION

This application is a continuation of U.S. application Ser. No. 12/408,745, filed Mar. 23, 2009, which claims priority from Japanese Patent Application No. 2008-163127 filed Jun. 23, 2008. The entire content of the priority application is incorporated herein by reference.

TECHNICAL FIELD

The present invention relates to an image forming apparatus provided with a drawer holding a plurality of process cartridges, the drawer being movable relative to an outer frame for access to the process cartridges.

BACKGROUND

A tandem type image forming apparatus is known in this field in which a plurality of photosensitive drums is arrayed in line. Laid-open Japanese Patent Application publication No. 2007-213018 discloses such image forming apparatus provided with a plurality of process cartridges each having each photosensitive drum, an intermediate transfer belt in direct confrontation with each photosensitive drum, and a drawer holding the plurality of process cartridges and capable of being drawn from a main frame of the image forming apparatus. Toner image on the photosensitive drum is first transferred onto the intermediate transfer belt, and is then transferred onto a sheet from the intermediate transfer belt. Exchange of a process cartridge with a new process cartridge can be performed by pulling the drawer.

In case of a direct tandem type image forming apparatus in which a toner image is directly transferred onto a sheet from the photosensitive drum, a sheet conveyer belt must be provided in direct confrontation with each photosensitive drum instead of the intermediate transfer belt. In the latter case, sheet jamming may occur between the photosensitive drum and the conveyer belt. Detaching the drawer out of a drawer insertion space can allow a user to be accessible to the jammed sheet through the drawer insertion space, and therefore, the jammed sheet can be removed. To this effect, drawer detachable construction is required. However, in this case, a heavy drawer holding process cartridges must be lifted and assembled to the drawer insertion hole, rendering the sheet removing work cumbersome. Further, the drawer must be held at a position so as not to be completely detached from the frame, if only one of the process cartridges is to be exchanged with the new cartridge among the plurality of cartridges.

SUMMARY

In view of the foregoing, it is an object of the present invention to provide an image forming apparatus capable of performing removal of jammed sheet and exchange of process cartridge without complete detachment of the drawer from the frame.

This, and other objects of the present invention will be attained by providing an image forming apparatus for forming an image on a sheet including a casing, a plurality of process cartridges, a conveyer belt, a drawer, and, a regulation mechanism. The plurality of process cartridges are arrayed in line in an arraying direction. Each process cartridge has a photosensitive drum. The conveyer belt is configured to convey the sheet. The drawer detachably holds the plurality of process cartridges and is constantly supported to the casing. The drawer is movable in a pull-out and push-in direction parallel to the arraying direction relative to the casing to one of a first position where each photosensitive drum is in direct confrontation with the conveyer belt, a second position where all of the plurality of process cartridges are positioned out of the casing, and a third position further outward, relative to the casing in the pull-out direction, of the second position for removing a jammed sheet. The regulation mechanism is configured to regulate movement of the drawer and includes a first regulation mechanism, and a second regulation mechanism. The first regulation mechanism is configured to maintain the drawer at the second position engaged with the casing and to prevent the drawer from moving toward the third position in a phase where a process cartridge positioned at a most upstream side in the pull-out direction is held in the drawer. The first regulation mechanism allows the drawer to move to the third position from the second position at a phase where the process cartridge positioned at the most upstream side is removed from the drawer. The second regulation mechanism is configured to maintain the drawer at the third position engaged with the casing.

BRIEF DESCRIPTION OF THE DRAWINGS

In the drawings;

FIG. 2(*b*) is an enlarged partial perspective view of a portion X encircled by a broken line in FIG. 2(*a*) as viewed from a position diagonally below the drawer;

FIG. 3(*b*) is a schematic side view showing the drawer in which a rearmost process cartridge is removed from the drawer in the printer according to the embodiment;

FIG. 4(*b*) is a perspective view of a side panel with a part thereof being cut-away in the color laser printer according to the embodiment;, FIG. 5(*a*) is a perspective view of the color laser printer according to the embodiment, and showing a state in which the drawer is pulled to a replacement position of a process cartridge;

FIG. 5(*c*) is a perspective view of the color laser printer according to the embodiment, and showing a state in which the drawer is pulled to a position for removing jammed sheet;

FIG. 6(*b*) is a cross-sectional view taken along the line VI-VI in FIG. 4(*b*) and showing a state where the first abutment portion is disengaged from the first regulation wall in the color laser printer according to the embodiment; and FIG. 6(*c*) is a cross-sectional view taken along the line VI-VI in FIG. 4(*b*) and showing a state where a second abutment portion is brought into abutment with a second regulation wall in the color laser printer according to the embodiment.

DETAILED DESCRIPTION

A color laser printer as an image forming apparatus according to an embodiment of the present invention will be described with reference to FIGS. 1 through 6(*b*). Throughout the specification, the terms "upward", "downward", "upper", "lower", "above", "below", "beneath", "right", "left", "front", "rear" and the like will be used assuming that the image forming apparatus is disposed in an orientation in which it is intended to be used. More specifically, in FIG. 1 a right side and a left side are a front side and a rear side, respectively.

Figure 1:
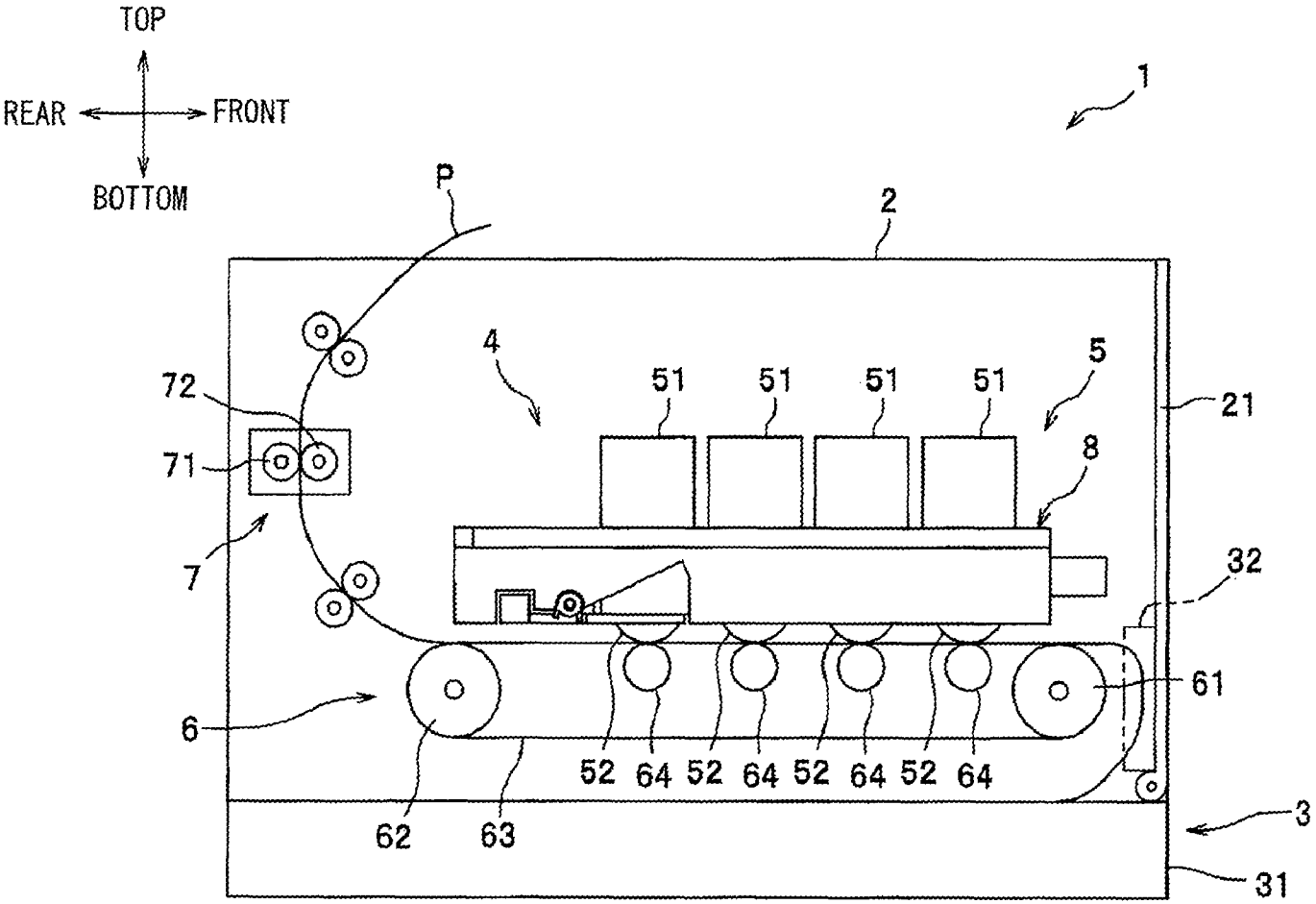
FIG. 1 is a schematic cross-sectional view of a color laser printer as an image forming apparatus according to an embodiment of the present invention.

As shown in FIG. 1, the color laser printer 1 has a generally box shaped casing 2, and generally includes a sheet supply section 3 for supplying a sheet P, and an image forming section 4 for forming an image on the sheet P supplied from the sheet supply section 3, those accommodated in the casing 2. A thick sheet of paper, a thin sheet of paper, and a postcard are examples of the sheet P.

The sheet supply section 3 generally includes a sheet cassette 31, and a sheet supplying mechanism 32 including a sheet supply roller (not shown) and a sheet guide (not shown) for supplying a sheet P in the sheet cassette 31 to the image forming section 4.

The image forming section 4 includes exposure units (not shown), a process unit 5, a transfer unit 6, and a fixing unit 7. The process unit 5 includes a plurality of (four) process cartridges 51 arrayed in a frontward/rearward direction, and a movable drawer 8 that detachably holds therein these process cartridges 51. Each process cartridge 51 includes a photosensitive drum 52, a charger, a developing roller, and a toner containing chamber. An outer peripheral surface of the photosensitive drum charged by the charger is exposed to light by the exposure unit, so that an electrostatic latent image based on image data is formed on the surface. Then toner will be supplied to an area of the electrostatic latent image through the developing roller, whereupon a visible toner image is formed on the surface of the photosensitive drum 52.

Various types of exposure units are conceivable. For example, the exposure unit can employ laser beam. Alternatively, a plurality of LEDs can be used. Further, various modification to configuration of the process cartridge is conceivable as long as the cartridge can allow the laser beam to pass therethrough or to allow the LEDs to be installable at a proper location in the image forming section 4.

The casing 2 has a front opening, and a front cover 21 is pivotally movably connected to the casing 2 to selectively open the front opening when the front cover 21 is pivotally moved downward and frontward. The drawer 8 is supported to the casing 2 and movable frontward/rearward. The drawer 8 can be pulled frontward after the front cover is opened. Details of the drawer 8 will be described later.

The transfer unit 6 includes a drive roller 61, a driven roller 62, an endless conveyer belt 63, and a transfer roller 64. The endless conveyer belt 63 is mounted under tension over the drive roller 61 and the driven roller 62 spaced away from the drive roller 61 in the frontward/rearward direction. Each of the photosensitive drums 52 is in direct confrontation with an outer surface of the conveyer belt 63. The transfer roller 64 is positioned at an inner peripheral surface side of the conveyer belt 63 for nipping the belt 63 in cooperation with the photosensitive drum 52.

Transfer bias will be applied to the transfer roller 64 from a high voltage circuit board (not shown). The photosensitive drum 52 and the transfer roller 64 nips therebetween the sheet P conveyed by the conveyer belt 63, whereupon the toner image carried on the photosensitive drum 52 is transferred onto the sheet P.

The fixing unit 7 includes a heat roller 71 and a pressure roller 72 in opposition thereto. The toner image carried on the sheet P can be thermally fixed to the sheet P upon application of heat and pressure applied by these rollers 71 and 72.

Figure 2A:
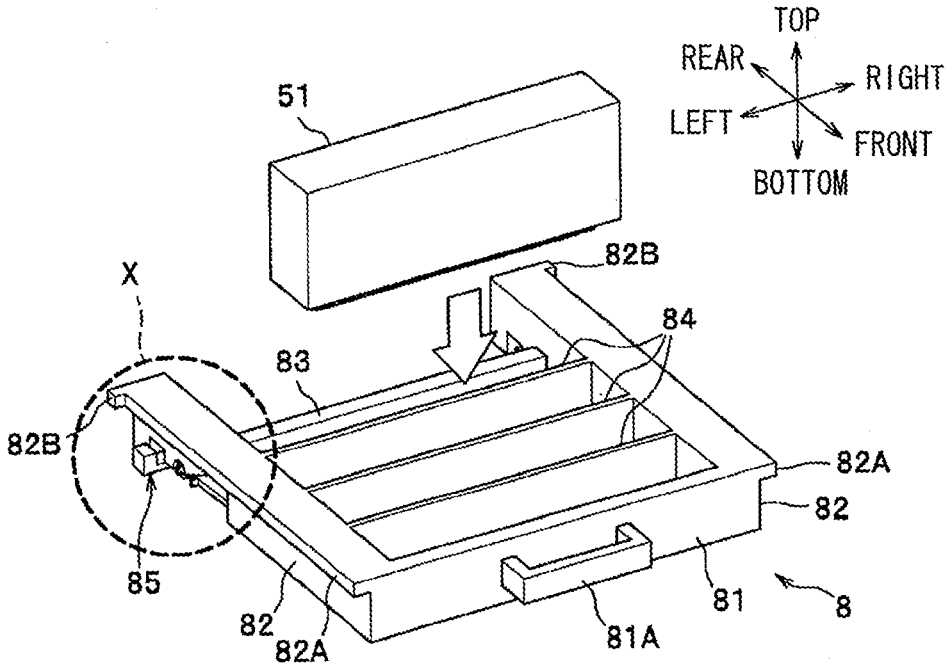
FIG. 2(*a*) is a perspective view of a drawer in the color laser printer as viewed from a position diagonally above the drawer according to the embodiment.
Figure 2B:
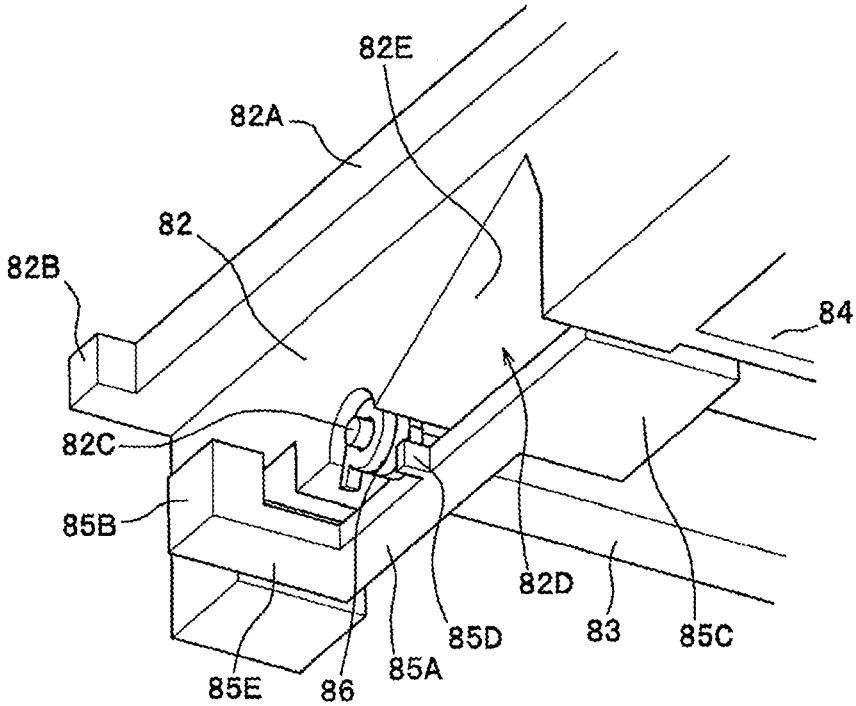

Next, details of the drawer 8 will be described. As shown in FIG. 2(*a*), the drawer 8 includes a front frame 81, a pair of side frames 82, a rear frame 83, three beams 84 and a change-over lever 85. The front frame extends in a lateral direction (rightward/leftward direction), i.e. a widthwise direction of the sheet P, and has a longitudinally center portion provided with a U-shaped handle 81A protruding frontward therefrom.

Each side frame 82 extends rearward from each longitudinally end portion of the front frame 81. A flange or a rib 82A extends in the frontward/rearward direction and protrudes laterally outward from each upper portion of each side frame 82, so that an upper surface of the front frame 81 is flush with an upper surface of the flange 82A. An abutment projection 82B protrudes laterally outward from a rear end portion of each side frame 82. The abutment projection 82B (will be referred to as "a second abutment portion 82B") constitutes a part of a regulation mechanism that regulates or restricts the movement of the drawer 8 in a pull-out direction of the drawer 8.

The rear end portion of the side frame 82 is also provided with a pivot shaft portion 82C and is formed with a regulation groove 82D. The shaft portion 82C protrudes laterally outward for pivotally movably supporting the change-over lever 85. The regulation groove 82D is configured into generally V-shape at a side view for regulating or restricting the pivotal movement of the change-over lever 85. The regulation groove 82D has a slant surface 82E slanting upward from a rear end toward a front end of the groove. The change-over lever 85 has a front pivot arm abuttable on the slant surface 82E as a result of the pivot motion of the change-over lever 85. This abutment maintains or defines an inclined posture of the change-over lever 85 relative to a horizontal plane.

The rear frame 83 spans between the pair of side frames 82 and 82 at positions slightly frontward from the rearmost ends of the side frames 82. A rectangular frame body is defined by the front frame 81, the rear frame 83 and the pair of side frames 82. Each side frames 82 has a rear portion rearward of the rear frame 83. That is, the rear portion constitutes an extension portion extending rearward from the rectangular frame body.

Figure 3A:
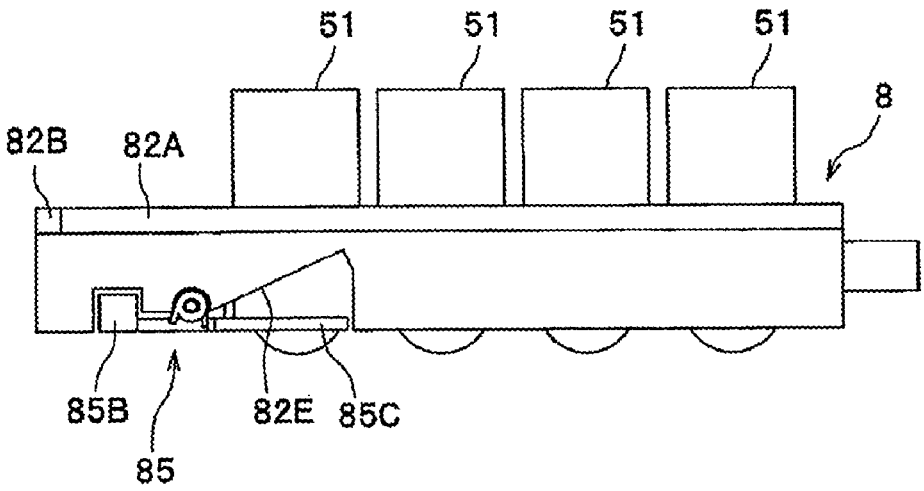
FIG. 3(*a*) is a schematic side view showing the drawer fully assembled with process cartridges in the printer according to the embodiment.
Figure 3B:
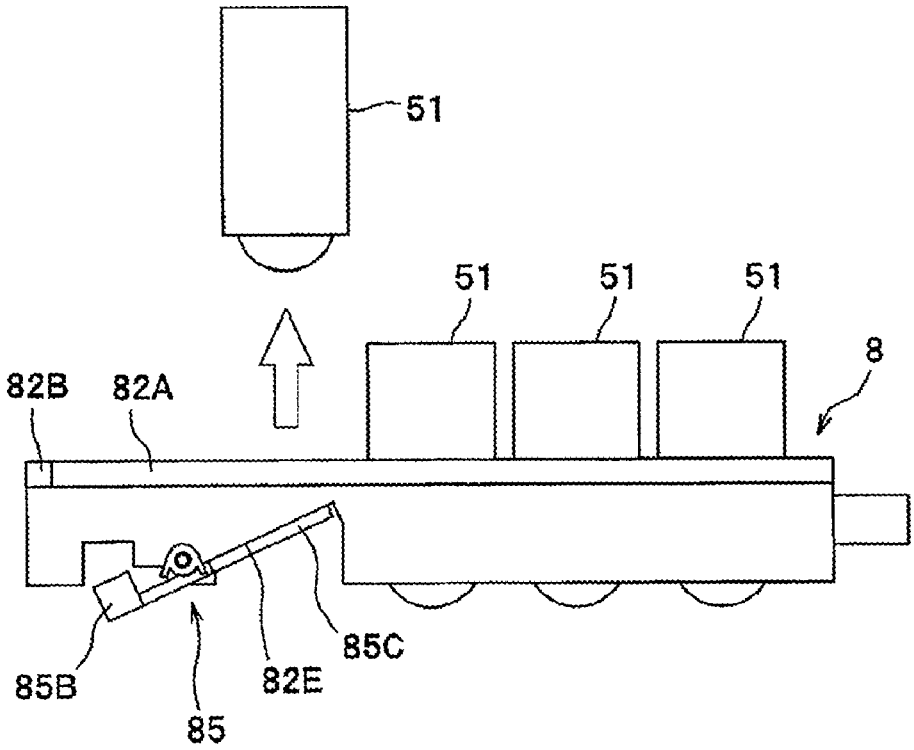

Three beams 84 are positioned within the rectangular frame body and each beam 84 spans between the pair of side frames 82 so as to provide four compartments. Further, these beams 84 are spaced away from each other at a constant distance within the rectangular frame body. Each process cartridge 51 can be inserted into associated one of the compartments, and is engageable with a part of the drawer 8 upon completion of insertion. Thus, process cartridges 51 are arrayed in line and positioned at predetermined positions with respect to the drawer 8 as shown in FIG. 3(*a*).

The change-over lever 85 is a component constituting a part of the regulation mechanism that regulates or restricts the movement of the drawer 8 in the pull-out direction thereof. As shown in FIG. 2(*b*) the change-over lever 85 includes a pivot arm portion 85A, an abutment portion 85B (will be referred to as "a first abutment portion 85B"), a cartridge abutment portion 85C and a spring seat portion 85D.

The pivot arm portion 85A is an elongated plate-like member having a longitudinally center portion provided with a protruding part (not shown) protruding to the pivot shaft 82C. The protruding part is pivotally supported to the pivot shaft 82C. The pivot arm portion 85A has a rear portion with respect to the pivot shaft 82C. The rear portion extends rearward of the rear frame 83.

The first abutment portion 85B is linked to the rear portion of the pivot arm portion 85A through a link portion 85E, so that the first abutment portion 85B is positioned laterally outward of the side frame 82. As shown in FIG. 3(*a*), the first abutment portion 85B is brought into an abutment position in abutment with a first regulation wall 22A3 (described later in connection with FIG. 4(*b*)) when the change-over lever 85 has a horizontal orientation or posture. Further, as shown in FIG. 3(*b*), the first abutment portion 85B is brought into a non-abutment position out of contact from the first regulation wall 22A3 when the change-over lever 85 has an inclined orientation or posture.

As shown in FIG. 2(*b*), the cartridge abutment portion 85C protrudes from the front portion of the pivot arm portion 85A toward a laterally inner side, so that the portion 85C is positioned laterally inward of the side frame 82. Further, the cartridge abutment portion 85C has an upper portion exposed to a space defined between the rearmost beam 84 and the rear frame 83. That is, the cartridge abutment portion 85C is abuttable on the rearmost process cartridge 51.

The spring seat portion 85D protrudes laterally outwardly from the front arm portion of the pivot arm portion 85A (the front arm portion is positioned frontward of the pivot shaft 82C). A torsion spring 86 functioning as a biasing member is supported on the pivot shaft 82C and is interposed between the side frame 82 and the spring seat portion 85D. Because of the biasing force of the torsion spring 86, the first abutment portion 85B is biased to maintain its non-abutment position relative to the first regulation wall 22A3 as shown in FIG. 3(*b*).

Upon installation of the rearmost process cartridge 51 into the drawer 8, the change-over lever 85 is maintained at its horizontal posture or orientation against the biasing force of the torsion spring 86, because the installed process cartridge 51 pushes the cartridge abutment portion 85C downward as shown in FIG. 3(*a*). On the other hand, if the rearmost process cartridge 51 is removed from the drawer 8, the change-over lever 85 is pivotally moved about the pivot shaft 82C because of the biasing force of the torsion spring 86, and maintains its inclined posture because of the abutment between the cartridge abutment portion 85C and the slant surface 82E as shown in FIG. 3(*b*).

Figure 4A:
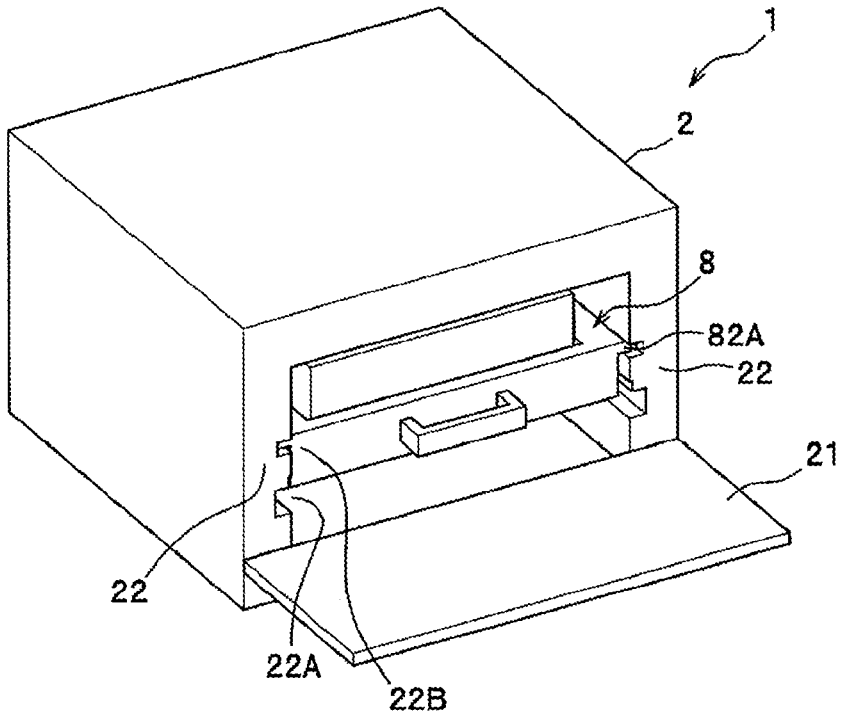
FIG. 4(*a*) is a perspective view of the color laser printer according to the embodiment in which a front panel is open.
Figure 4B:
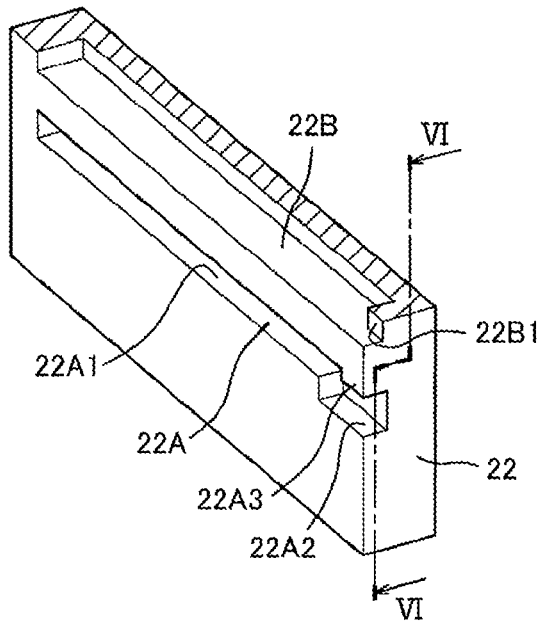

Next, a side panel, which is a part of the casing 2 and one of the components of the regulation mechanism for regulating or restricting the movement of the drawer 8, will be described. As shown in FIG. 4(*a*), the side panels 22 are positioned at laterally outer sides of the drawer 8 for guiding frontward/rearward movement of the drawer 8. More specifically, as shown in FIG. 4(*b*), the side panel has a laterally inner side formed with first and second slide guide grooves 22A and 22B extending in frontward/rearward direction. The first slide guide groove 22A is adapted to guide sliding movement of the first abutment portion 85B of the change-over lever 85, and the second slide guide groove 22B 85B is adapted to guide sliding movement of the rib 82A and the second abutment portion 82B of the drawer 8.

The first slide guide groove 22A is open at laterally inner side of the side panel and at a front end face thereof. The groove 22A has a crank shape including an elongated horizontal guide portion 22A1, a downwardly bent portion, and a front escape portion 22A2 displaced downward from the guide portion 22A1. The first regulation wall 22A3 is defined at a surface of the downwardly bent portion. As described above, the first abutment portion 85B of the change-over lever 85 is abuttable on the first regulation wall 22A3. The guide portion 22A1 has a width the same as that of the first abutment portion 85B. The downwardly bent portion has a width greater than a length of the first abutment portion 85B in frontward/rearward direction, so that the latter can be inclined within the downwardly bent portion. The abutment between the first abutment portion 85B and the first regulation wall 22A3 defines a "cartridge exchangeable position" of the drawer 8. The "cartridge changeable position" implies that all of the process cartridges 51 are moved out of the casing 2 facilitating exchange of any one of the process cartridges 51 with a new cartridge, yet the drawer 8 is still supported by the side panels 22.

The front escape portion 22A2 has a width greater than that of the guide portion 22A1, so as to prevent the first abutment portion 85B from being in contact with the front escape portion 22A2. The second slide guide groove 22B is open at laterally inner side of the side panel 22 and at the front end face thereof. The second slide guide groove 22B has a major guide portion with which the second abutment portion 82B slidingly moves, and has a front stop portion on which the second abutment portion 82B is abuttable. To this effect, the major guide portion has a depth in the lateral direction equal to a laterally protruding length of the second abutment portion 82B measured from the outer surface of the side frame 82, and the front stop portion has a depth in the lateral direction equal to a laterally protruding length of the rib 82A measured from the outer surface of the side frame 82. The front stop portion has a rear face serving as a surface of a second regulation wall 22B1 on which the second abutment portion 82B of the drawer is abuttable. The abutment between the second abutment portion 82B and the second regulation wall 22B1 defines a "processing position" of the drawer 8 ahead of the "cartridge exchangeable position" thereof. The "processing position" implies a position of the drawer 8 to execute removal of the jammed sheet after removal of the rearmost process cartridge 51 from the drawer 8.

The major guide portion of the second slide guide groove 22B has a rearmost end face on which the second abutment portion 82B is abuttable so as to stop the drawer 8 at an operable position (rearmost position) where the each photosensitive drum 52 of each process cartridge is in direct confrontation with the conveyer belt 63 enabling the image forming operation.

Figure 6A:
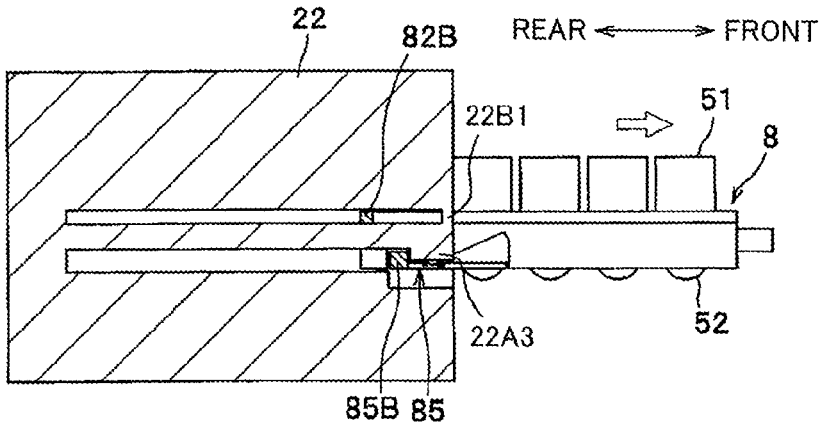
FIG. 6(*a*) is a cross-sectional view taken along the line VI-VI in FIG. 4(*b*) and showing a state where a first abutment portion is brought into abutment with a first regulation wall in the color laser printer according to the embodiment.
Figure 6B:
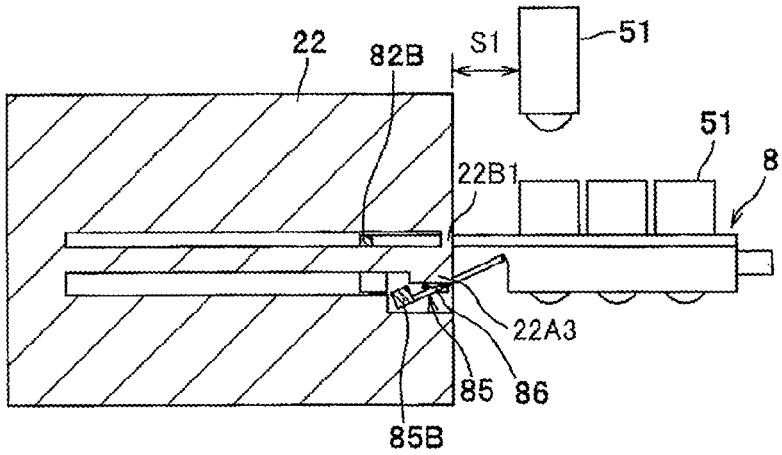
Figure 6C:
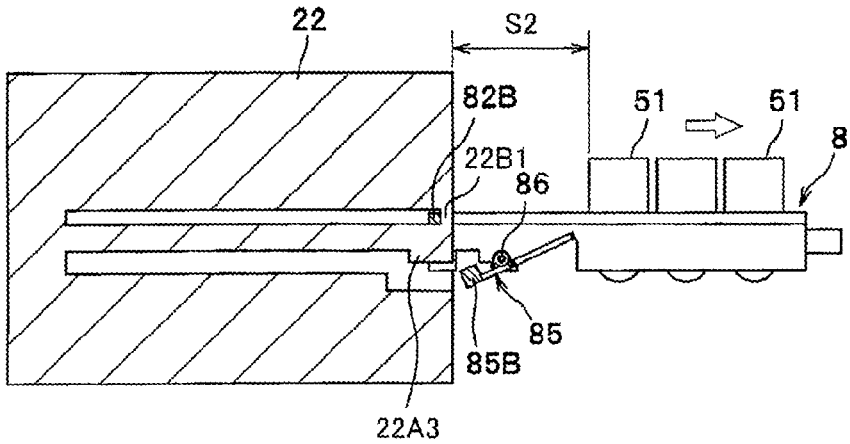

Further, as shown in FIG. 6(*a*), the rear end face (regulation surface) of the second regulation wall 22B1 is positioned frontward of the rear end face (regulation surface) of the first regulation wall 22A3. Furthermore, the drawer 8 is so configured that the front end face (abutment surface) of the second abutment portion 82B is positioned rearward of the front end face (abutment surface) of the first abutment portion 85B. With this geometrical arrangement, the first abutment portion 85B is brought into abutment with the regulation surface of the first regulation wall 22A3 prior to the abutment of the second abutment portion 82B onto the regulation surface of the second regulation wall 22B1. Incidentally, various modifications are conceivable as long as a distance between the abutment surface of the first abutment portion 85B and the regulation surface of the first regulation wall 22A3 is smaller than a distance between the abutment surface of the second abutment portion 82B and the regulation surface of the second regulation wall 22B1.

In operation, by pulling-out the drawer 8 after opening the front cover 21 as shown in FIGS. 4(*a*) and 5(*a*), the first abutment portion 85B of the drawer is brought into abutment with the first regulation wall 22A3 of the side panel 22 as shown in FIG. 6(*a*). Thus, the drawer 8 can be stopped at the cartridge exchangeable position. In this position, a user can easily exchange the process cartridge 51 with a new cartridge without holding the drawer 8 with his hand, since further frontward movement of the drawer 8 can be restrained by the first regulation wall 22A3.

Figure 5A:
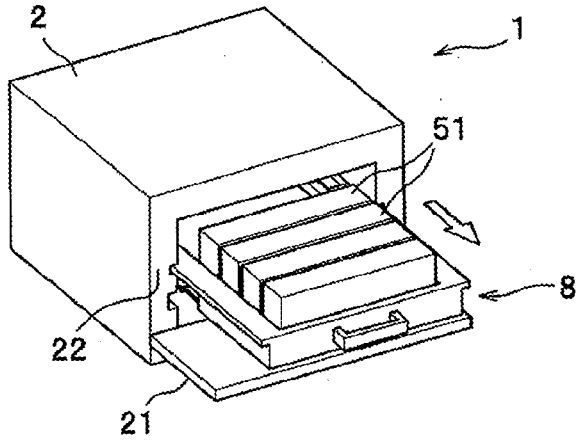
FIG. 5(*b*) is a perspective view of the color laser printer according to the embodiment, and showing a state in which the rearmost process cartridge has been removed from the drawer.
Figure 5B:
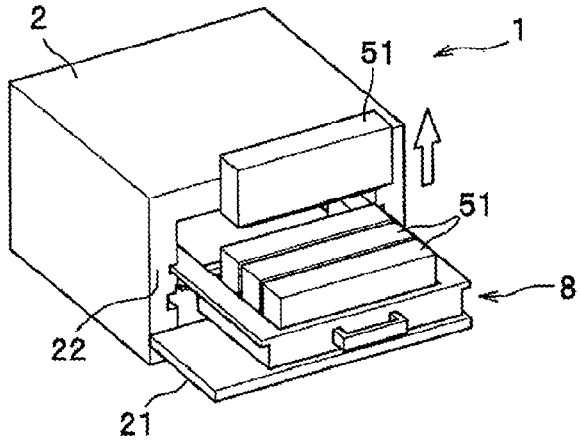
Figure 5C:
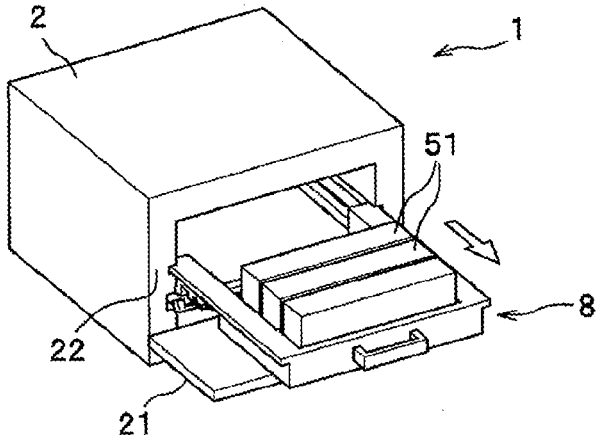

Then, as shown in FIG. 5(*b*), by removing the rearmost process cartridge 52 from the drawer 8, the change-over lever 85 will be inclined by the biasing force of the torsion spring 86, so that the first abutment portion 85B is disengaged from the first regulation wall 22A3 as shown in FIG. 6(*b*). Thus, the drawer 8 can further be pulled frontward. In this case, a gap S1 is provided as a result of removal of the rearmost process cartridge 51 from the drawer 8.

Then if the drawer 8 is further pulled frontward as shown in FIG. 5(*c*), the second abutment portion 82B is brought into abutment with the second regulation wall 22B1, whereupon the drawer is stopped at the "processing position" ahead of the "cartridge exchangeable position" as shown in FIG. 6(*c*). In this case, a gap S2 greater than the gap S1 is provided. Therefore, the user can easily access to the jammed sheet through the increased gap S2.

The above-described embodiment can provide various advantages. More specifically, exchange of the process cartridge 51 can be performed without hand-supporting the drawer 8 at the exchanging position, facilitating the exchanging work. Further, sheet jamming can be processed without removing the drawer 8 out of the casing 2. Therefore, cumbersome work such as removing a heavy drawer out of the casing and then assembling the heavy drawer into the casing can be eliminated.

Further, since the abutment surface of the first abutment portion 85B provided in the change-over lever 85 is positioned reward of the rear frame 83, large pulling out length of the drawer 8 at its cartridge exchangeable position can be provided. Accordingly, relatively wide space can be provided between the rear surface of the rearmost process cartridge 51 and the casing 2, facilitating detachment and attachment work of the rearmost process cartridge 51.

Further, since the second abutment portion is positioned at the rearmost end portion of the side frame 82, large pulling out length of the drawer 8 at its sheet jamming processing position can be provided. Accordingly, wide space S2 can be provided facilitating the removal of the jammed sheet.

Further, since the first abutment portion 85B can be disengaged from the first regulation wall 22A3 by removing only one of the process cartridges 51 from the drawer 8, facilitating the removal of the jammed sheet in comparison with a case necessitating the removal of two or more process cartridges from the drawer.

In the above-described embodiment, various modifications are conceivable. For example, in the above-describe embodiment, four process cartridges are arrayed in line, and the pivotal movement of the change-over lever 85 occurs upon abutment of the change-over lever 85 on the rearmost process cartridge 51. However, two cartridges among a plurality of cartridges are juxtaposed side by side in the lateral direction, so that the two process cartridges are positioned as rearmost cartridges. In the latter case, pivotal movement of the change-over lever 85 occurs upon abutment of the change-over lever 85 on the rearmost two process cartridges.

Further, in the above-described embodiment, the torsion spring 86 is used for biasing the change-over lever 85 toward the non-abutment position. However, the change-over lever can be normally positioned at its non-abutment position because of its own weight without employment of the torsion spring 86. Further, a coil spring or a leaf spring is available instead of the torsion spring 86.

Further, in the above-described embodiment, the longitudinally center portion of the change-over lever 85 is pivotally supported, so that the first abutment portion 85B is located at the longitudinally one end portion of the lever 85 and the cartridge abutment portion is located at the longitudinally another end portion thereof. However, a modified change-over lever can be provided such that the first abutment portion is located at the longitudinally one end portion, a pivotally supporting portion is located at the longitudinally other end portion, and the cartridge abutment portion is located the longitudinally center portion.

Further, inventive concept is also available to other kinds of image forming apparatus such as a copying machine, facsimile machine, and a multifunction device instead of the color laser printer of the above-described embodiment. Further, OHP sheet is available as the sheet P in the above described embodiment.

While the invention has been described in detail with reference to the embodiments thereof, it would be apparent to those skilled in the art that various changes and modifications may be made therein without departing from the spirit of the invention.

What is claimed is:

1. An image forming device for forming an image on a sheet with a plurality of process cartridges comprising:

a casing formed with an opening, the plurality of process cartridges being detachable from the casing;

a movable member detachably supporting the plurality of process cartridges and linearly movable through the opening between a mounting position and an exchangeable position, the mounting position being inside the casing and corresponding to an image forming position where the plurality of process cartridges performs image formation on a sheet, and in the exchangeable position all process cartridges being detachable from and attachable to the movable member;

a retraction unit that retracts the movable member from the exchangeable position to a retracting position providing an open state of the opening for accessing to a jammed sheet inside the casing through the opening; and, an engagement structure that makes engagement of the movable member with the casing to maintain the movable member at the retracting position.

* * * * *